US010723505B2

(12) United States Patent
Lopez Masague

(10) Patent No.: US 10,723,505 B2
(45) **Date of Patent: *Jul. 28, 2020**

(54) STORAGE AND SHIPPING BOX

(71) Applicant: Embalajes Capsa, S.L., Canet de Mar (ES)

(72) Inventor: Manuel Lopez Masague, Canet de Mar (ES)

(73) Assignee: Embalajes Capsa, S.L., Canet de Mar (ES)

( * ) Notice: Subject to any disclaimer, the term of this patent is extended or adjusted under 35 U.S.C. 154(b) by 0 days.

This patent is subject to a terminal disclaimer.

(21) Appl. No.: 16/275,777

(22) Filed: Feb. 14, 2019

(65) Prior Publication Data

US 2019/0177029 A1 Jun. 13, 2019

Related U.S. Application Data

(63) Continuation of application No. 15/589,640, filed on May 8, 2017, now Pat. No. 10,227,155, which is a (Continued)

(30) Foreign Application Priority Data

May 26, 2011 (EP) ..... 11382171

(51) Int. Cl.
*B65D 5/10* (2006.01)
*B65D 5/42* (2006.01)
(Continued)

(52) U.S. Cl.
CPC ..... *B65D 5/10* (2013.01); *B65D 5/0227* (2013.01); *B65D 5/42* (2013.01); *B65D 5/4608* (2013.01); *B65D 5/541* (2013.01)

(58) Field of Classification Search
CPC ..... B65D 5/42; B65D 5/0254; B65D 5/2057; B65D 5/10; B65D 5/0227; B65D 5/541
(Continued)

(56) References Cited

U.S. PATENT DOCUMENTS 225,189 A * 3/1880 Wenzel ..... B65D 5/106 229/158
1,672,634 A 6/1928 Walter
(Continued)

FOREIGN PATENT DOCUMENTS

FR 1189297 10/1959
FR 1578148 8/1969
(Continued)

OTHER PUBLICATIONS

U.S. Pat. No. 225,189, issued Mar. 2, 1880, G. C. Wenzel, "Package-Box."
(Continued)

*Primary Examiner* — Justin M Larson
(74) *Attorney, Agent, or Firm* — Edell, Shapiro & Finnan, LLC

(57) ABSTRACT

A storage and shipping box includes first closing flaps of the exterior of the box that extend from a pair of opposing sides of the upper face of the box and that are capable of being sealed, stapled or glued in order to carry out one or several shipments. The box further includes second closing flaps of the exterior of the box that extend from the other opposing sides of the upper face of the box. The second flaps include a closing element to open and close the box as many times as needed and are capable of being used for the storage of products or for preparing orders before or after carrying out a shipment.

20 Claims, 11 Drawing Sheets

Related U.S. Application Data continuation of application No. 14/725,325, filed on May 29, 2015, now Pat. No. 9,643,748, which is a continuation of application No. 14/122,408, filed as application No. PCT/IB2012/052633 on May 25, 2012, now Pat. No. 9,061,789.

(51) Int. Cl.
*B65D 5/02* (2006.01)
*B65D 5/54* (2006.01)
*B65D 5/468* (2006.01)

(58) Field of Classification Search
USPC ..... 229/155, 132, 136, 158, 222, 241, 921, 229/156, 157, 198
See application file for complete search history.

(56) References Cited

U.S. PATENT DOCUMENTS

| | | | | |
|---|---|---|---|---|
| 1,869,742 | A | 8/1932 | Edmunds | |
| 2,153,340 | A | 4/1939 | Reid | |
| 2,362,181 | A | 11/1944 | Zimmerman | |
| 2,685,400 | A | 8/1954 | MacArthur, Jr. | |
| 2,986,324 | A * | 5/1961 | Anderson, Jr. | B65D 5/46192 229/117.13 |
| 3,263,899 | A * | 8/1966 | Collura | B65D 5/541 229/212 |
| 3,306,521 | A | 2/1967 | Giacovas | |
| 4,027,818 | A | 6/1977 | Stoll | |
| 4,436,244 | A * | 3/1984 | Morris | B65D 5/46016 229/117.12 |
| 5,054,618 | A * | 10/1991 | Kim | B65D 77/36 229/123.3 |
| 5,746,371 | A * | 5/1998 | Ben-Haim | B65D 5/5415 229/121 |
| 6,689,244 | B2 * | 2/2004 | Schwertfeger | B65D 5/0236 156/247 |
| 9,061,789 | B2 * | 6/2015 | Lopez Masague | B65D 5/0227 |
| 9,643,748 | B2 * | 5/2017 | Lopez Masague | B65D 5/0227 |
| 9,714,112 | B1 * | 7/2017 | Lin | B65D 5/541 |
| 9,718,603 | B2 * | 8/2017 | Lopez Masague | B65D 5/10 |
| 10,227,155 | B2 * | 3/2019 | Lopez Masague | B65D 5/0227 |
| 10,358,254 | B2 * | 7/2019 | Buss | |
| 2003/0201315 | A1 | 10/2003 | Jamison et al. | |
| 2014/0197230 | A1 * | 7/2014 | Lopez Masague | B65D 5/0227 229/123.2 |
| 2016/0137335 | A1 * | 5/2016 | Mora | B65D 5/0227 53/412 |
| 2018/0170610 | A1 * | 6/2018 | Buss | B65D 5/6661 |

FOREIGN PATENT DOCUMENTS

| | | |
|---|---|---|
| JP | 53-63324 U | 5/1978 |
| JP | 3138515 U | 12/2007 |

OTHER PUBLICATIONS

Japanese Office Action in corresponding Japanese Patent Application No. 2014-511999, dated Apr. 27, 2016, along with English translation.

* cited by examiner

STORAGE AND SHIPPING BOX

CROSS REFERENCE TO RELATED APPLICATIONS

This application is a continuation of U.S. patent application Ser. No. 15/589,640 filed May 8, 2017, which is a continuation of U.S. patent application Ser. No. 14/725,325 filed May 29, 2015, now U.S. Pat. No. 9,643,748, issued on May 9, 2017, which is a continuation of U.S. patent application Ser. No. 14/122,408 filed Feb. 1, 2014, now U.S. Pat. No. 9,061,789, issued on Jun. 23, 2015, which is a national stage application of International Application No. PCT/IB2012/052633, filed on May 25, 2012, which claims the benefit of European Patent Application No. EP 11382171.4 filed on May 26, 2011, the entire contents of which are hereby incorporated by reference.

FIELD OF THE INVENTION

The present invention refers to a storage and shipping box, in particular a box that allows transporting products in a secure and sealed way, and the same box can also be used for storing and preparing orders, being able to be opened and closed as many times as needed.

BACKGROUND

Currently, transportation or shipping of products is done usually in cardboard boxes comprising closing flaps that allow to sealingly closing the box. To this end, on said flaps an adhesive tape, staples or glue is placed.

These currently known transportation or shipping boxes have the drawback of not being specially designed to be used as storage boxes or for preparing orders ("picking"). This way, when the adhesive tape is removed, the closing flaps can be torn, thus preventing the use of the box as a storage box that in turn can be closed again without using new adhesive tape, staples or glue.

Even if the closing flaps are not damaged during the removal of the adhesive tape, the conventional boxes for shipping or transporting products do not have any closing element to allow the box to be opened and closed as many times as needed, which is necessary for its use as a storage box or for preparing orders ("picking").

It is usual for conventional shipping or transportation boxes to be used as storage boxes, but they are not correctly closed, allowing dust and dirt to get in the box, as well as wasting time by constantly sealing and unsealing the box.

Currently, there are boxes which flaps allow opening and closing the box with its external flaps, which would be damaged if they were sealed, stapled or glued for their shipping, preventing the original function of the box.

If they are correctly closed, for example using an adhesive tape, staples, glue or the like, it is necessary to carry out the opening and closing operation each time the user accesses inside the box, which can be usual.

Boxes comprising two sets of flaps are known; however, they cannot be used as shipping and storage boxes in a particular order, i.e., as shipping box first and as storage box subsequently or vice versa.

For example patent FR 1,189,297 describes a cardboard container comprising some first closing flaps and some second flaps which are used to form a handle.

Unlike the box of the present invention, this container is not a packaging box but a basket whose top flaps form a handle, whose function is to facilitate its handling by hand.

Patent FR 1,578,148 describes a packaging box which purpose is to easily see if it has been tampered with, not for a double use. This packaging box cannot be used to carry out several shipments, as it cannot be sealed a second time due to some of its flaps being separated once it has been used. Besides, due to the closing system through a projection that is introduced in a slot, the box can be opened when applying pressure from the top and it's difficult to close before carrying out a shipment or when the box is full, as the inner flaps or the load inside make the insertion of the projection in the slot difficult.

U.S. Pat. No. 1,869,742 describes a box comprising two sets of flaps. This box's flaps are designed to be used one way only, using some inner flaps as a base to allow gluing additional flaps thereon. This box, once used, cannot be reused as a storage box, since the inner flaps tear upon opening.

U.S. patent publication 2003/0201315 describes a box comprising two sets of flaps. Unlike the box of the present invention, the two sets of flaps are used for sealing and only have a shipping use.

Therefore, the need for a box that could be indistinctly used as a shipping or transportation box and as a storage box or for preparing orders ("picking") or vice versa, is evident, allowing to seal the box when it is transported and at the same time, comfortably opening and closing it as needed when it is used as a storage box or for preparing orders ("picking").

SUMMARY

With the storage and transporting box of the invention said aforementioned drawbacks can be solved, presenting other advantages that will be further described.

The storage and shipping box of the present invention comprises first closing flaps of the exterior of the box, said first flaps extending from a pair of opposing sides of the upper face of the box, said first flaps being susceptible to be sealed with adhesive tape, staples or glue in order to carry out one or several shipments, and it is characterized in that it also comprises second closing flaps of the exterior of the box, said second flaps extending from the other two opposing sides of the upper face of the box, said second closing flaps including a closing element to open or close the box as many times as needed, said second closing flaps being susceptible to be used for the storage of products or for preparing orders before or after carrying out a shipment.

Thanks to these features, the box of the present invention can be suitably used for shipping or transporting products thanks to the first closing flaps, and for storing products or preparing orders ("picking") thanks to the second closing flaps.

Particularly, the box of the present invention has the advantage of being used one or several times as a shipping and storage box in any particular order, i.e., as shipping box first and storage box subsequently or vice versa. Unlike other boxes in the state of the art, the box of the present invention can be used to carry out more than one shipment without losing its alternative function as a storage box; therefore, a very versatile box is achieved.

Advantageously, said first closing flaps of shipment have dimensions such that they are at least substantially in contact with each other by their opposing ends in the closing position.

Optionally, said first closing flaps of shipment can be partially or completely overlapped in their closing position.

According to an embodiment, the opposing ends of said first closing flaps are separated from one another at a distance equal to or less than 6 cm, so that said first flaps are always susceptible to be sealed by means of an adhesive tape.

If wished, one of said first closing flaps of shipment can comprise a tear strip to facilitate the opening of the box of the present invention when it is closed by its first closing flaps.

In this case, in its closing position, said tear strip is overlapping other of said first closing flaps of shipment.

If wished, one of said first closing flaps could comprise double-sided adhesive tape to facilitate the closing of the first closing flaps.

Optionally, if wished, a second double-sided adhesive tape can be applied to the opposing flap of said first closing flaps allowing a second use for the shipment of the box and transforming it into a reusable box at the same time.

According to a preferred embodiment, preferably, it is understood as a closing element, an element that allows opening and closing the box as many times as needed avoiding the use of adhesive tape, staples or glue.

For example, advantageously, said closing element can be of the type that allows interlocking the opposing ends of said second flaps of storage. In this case, preferably, said closing element will comprise at least a slot provided in each of the opposing ends of said second flaps for interlocking said second flaps of storage through said slots.

According to a preferred embodiment, said closing element of the second closing flaps comprises a series of tabs attachable to each other through said interlocking slots provided in each flaps. However, according to this embodiment, the closing element could be any closing element suitable to allow interlocking the opposing ends of the second flaps, since this interlocking type of closing allows closing the box in an effective way, keeping it full and with the first closing flaps inside. Thanks to this, upon being able to keep the box closed with the first closing flaps inside covering the whole opening of the box, a very effective storage box is obtained, since said first flaps protect all the contents of the box. On the other hand, the interlocking closing system has the advantage of giving the box stacking resistance with regards to other conventional boxes when the interlocking flaps are inside during shipping, even when the box is half full. This is due to the fact that the interlocking closing system has a high mechanical resistance to collapsing.

Preferably, one of the tabs of the closing element comprises a folding line, which facilitates the opening and closing of the box of the present invention.

As mentioned before, the box of the present invention has the advantage of being resistant to stacking and the contents of the box is protected thanks to the fact that the flaps will always be placed one over another, so that there will always be a double thickness of the material. This is especially useful, for example, when a seal is cut on the box of the present invention when it is being used as a shipping box, since without this double thickness, the contents of the box could be accidentally cut. Furthermore, the box of the present invention can be closed with the two sets of flaps even in the event that is full.

According to an embodiment, said box comprises a plurality of faces that define a substantially parallelepiped body, including said first flaps of shipment in the two opposing sides of the upper face of said body and said second flaps of storage in the other two opposing sides of said upper face and is characterized in that the sum of the length (11, 11') of said first flaps is:

equal to the length (L2) of the sides of the box that include the second flaps or, greater than the length (L2) of the sides of the box that include the second flaps or, equal to the length (L2) of the sides of the box that include the second flaps minus a separation distance equal to or less than 7.5 cm, preferably equal to or less than 6 cm, said distance always guaranteeing the possibility to seal the first flaps by means of an adhesive tape.

According to the same embodiment, at least one of said second closing flaps of storage extends from one of the sides of the upper face of said body at a distance (12) which is greater than half the length (L1) of the other two sides of the face that include the first flaps of shipment. Thus, a correct configuration to apply to a closing element is guaranteed.

Preferably, the sides of the upper face of the body from which said first and second flaps extend, comprise indents that are substantially aligned among one another once the box is disassembled. Thus, the indiscriminate use of either the first or second flaps to close the exterior of the box is facilitated.

Preferably, said box or parallelepiped body is made of a sheet material that has been punched to form a blank that can be formed into said box.

Advantageously, the sheet material of said body includes paper pulp, or is made of paper pulp, such as cardboard.

In the present invention, by storage operation or preparing products it is understood an operation in which the box is filled and closed to store products by means of the aforementioned second closing flaps which include a closing element that allows opening and closing the box as many times as needed without the need to seal the box with adhesive tape, staples or glue. By shipping operation or shipment, it is understood an operation in which the box is filled and closed to ship the product by means of the aforementioned first flaps using sealing elements such as adhesive tapes, glue or staples.

BRIEF DESCRIPTION OF THE DRAWINGS

For a better understanding of what has been disclosed some drawings are attached in which, diagrammatically and only as a non-limitative example, an embodiment is shown.

DETAILED DESCRIPTION

Figure 1:
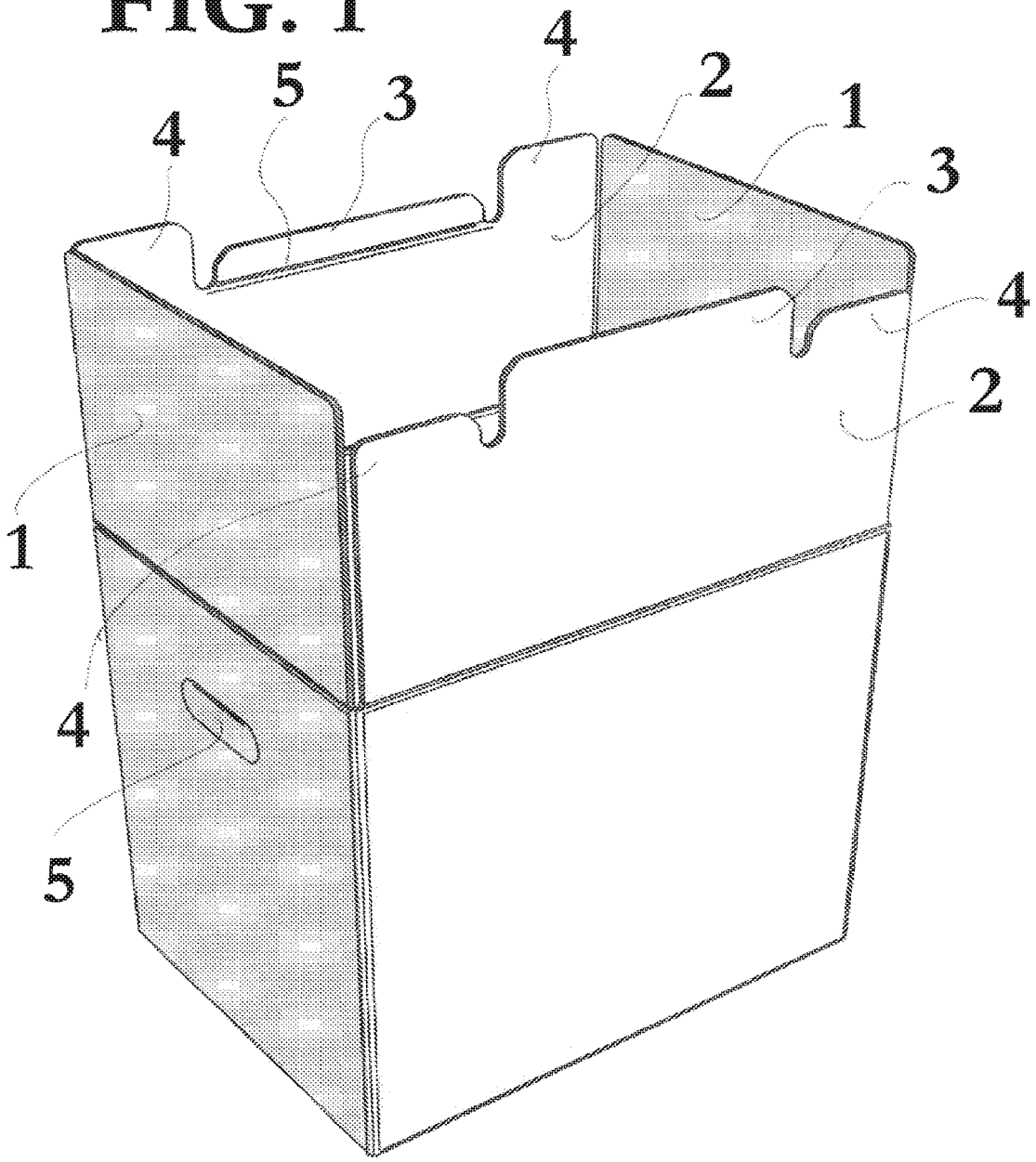
FIG. 1 is a perspective view of a box of the present invention in its opened position, according to a first embodiment.

As shown in FIG. 1, the box of the present invention has a parallelepiped body made of a sheet material, such as cardboard whose upper face is provided with two sets of closing flaps of the exterior of the box: a first pair of closing flaps 1 for its use as a shipping or transportation box and a second pair of closing flaps 2 for its use as a storage box.

Figure 3:
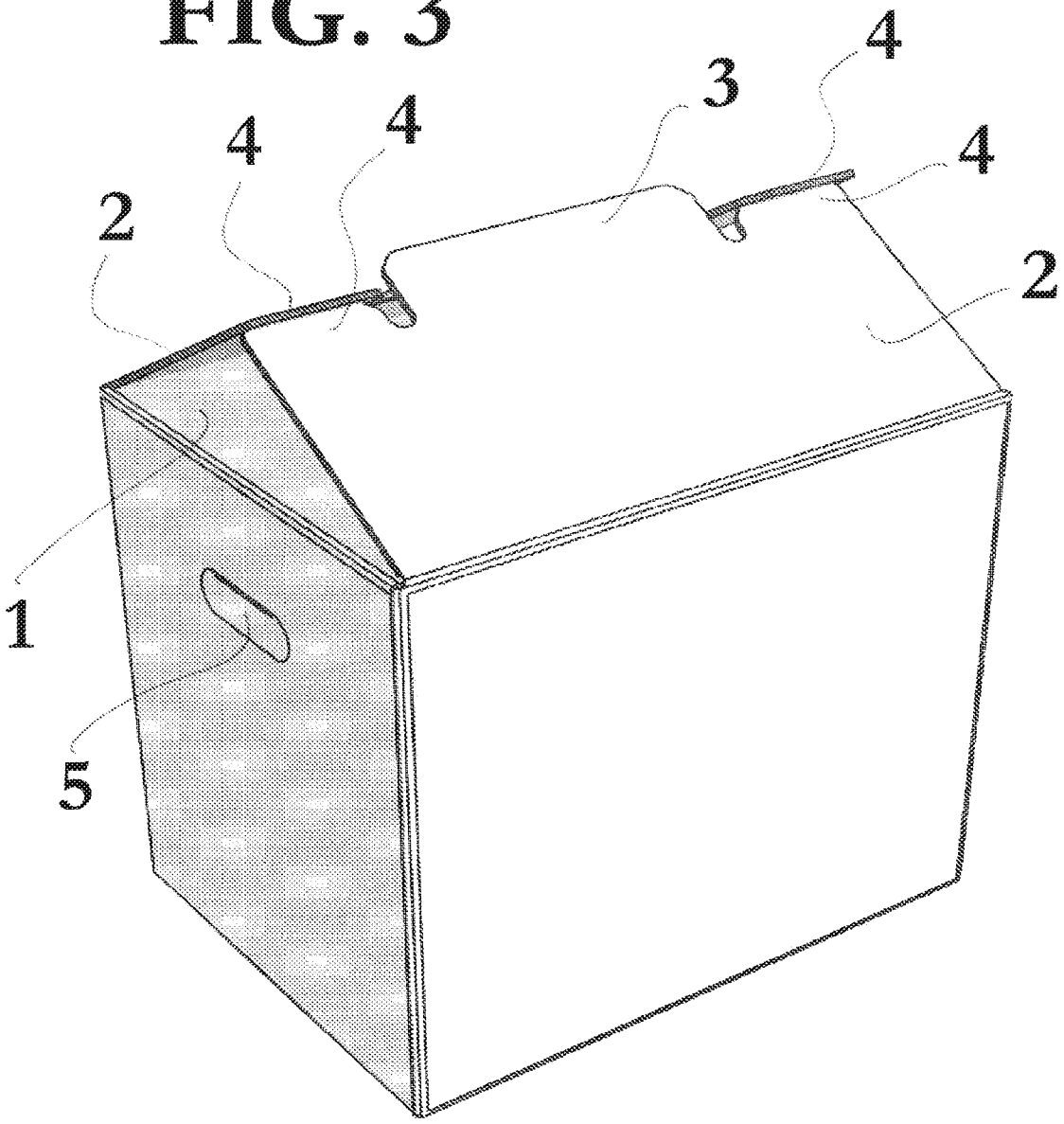
Figure 4:
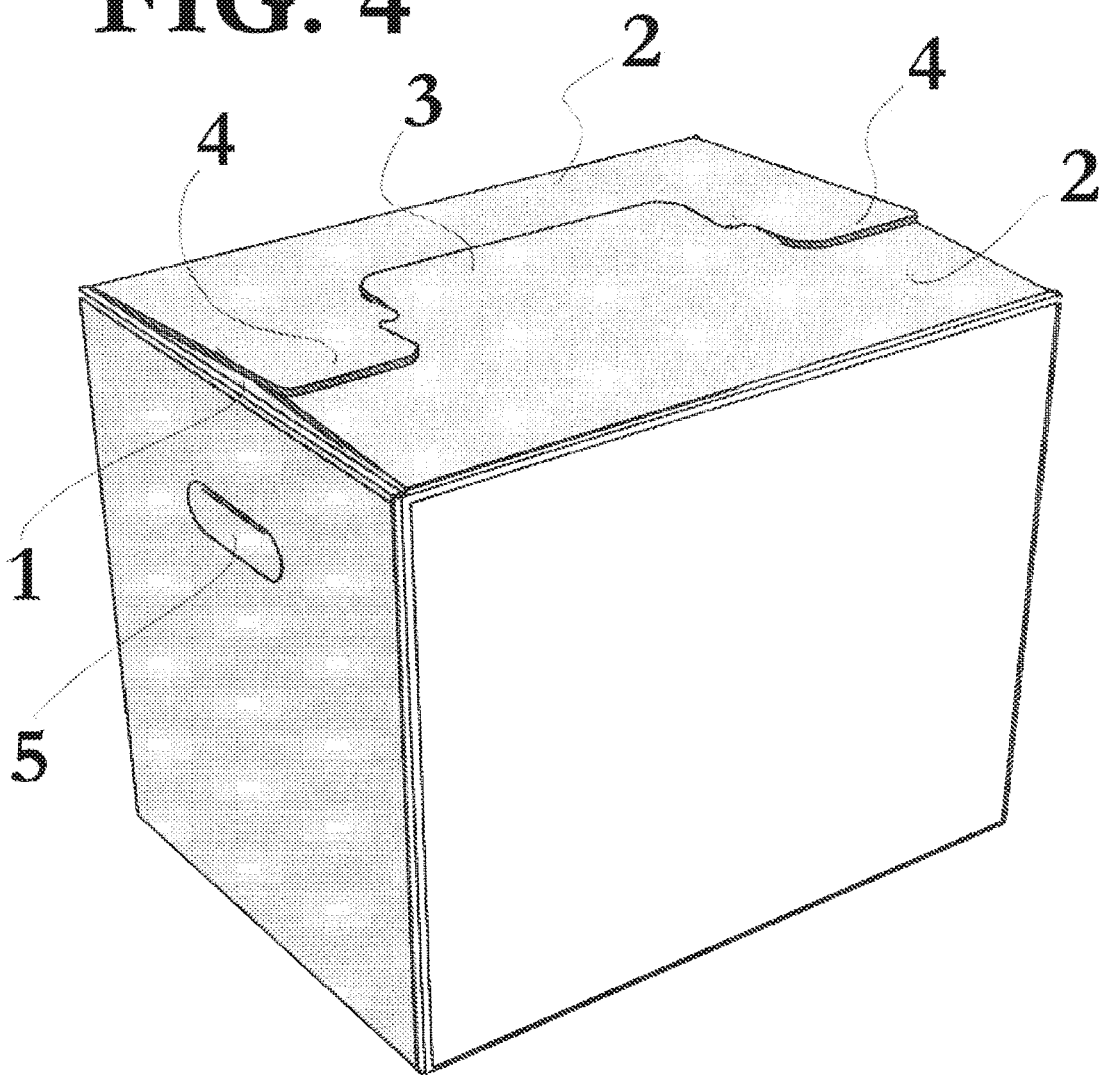

Said second closing flaps 2 comprise a closing element that allows easily opening and closing the box as many times as needed and is suitable to allow interlocking the opposing ends of the second flaps, since this type of interlocking closing allows effectively closing the box keeping it full and with the first closing flaps intact inside the box (see FIGS. 3 and 4).

In the shown embodiment, said closing element is formed, in each flap 2, by a central tab 3 and two lateral tabs 4 attachable to the tabs of the opposing flap 2 through interlocking slots 8 provided in each flap 2.

One of said central tabs 3 comprises a folding line 5, which facilitates the opening and closing of the box by said second closing flaps 2.

Even though in the figures an embodiment of the closing element with tabs 3, 4 has been shown, it is evident that the closing element can be different, but must be suitable to open and close the box as many times as needed.

It must also be pointed out that the box of the present invention can comprise handle-like holes 5 to facilitate the shipping of the box, even though said holes 5 are not essential.

Figure 2:
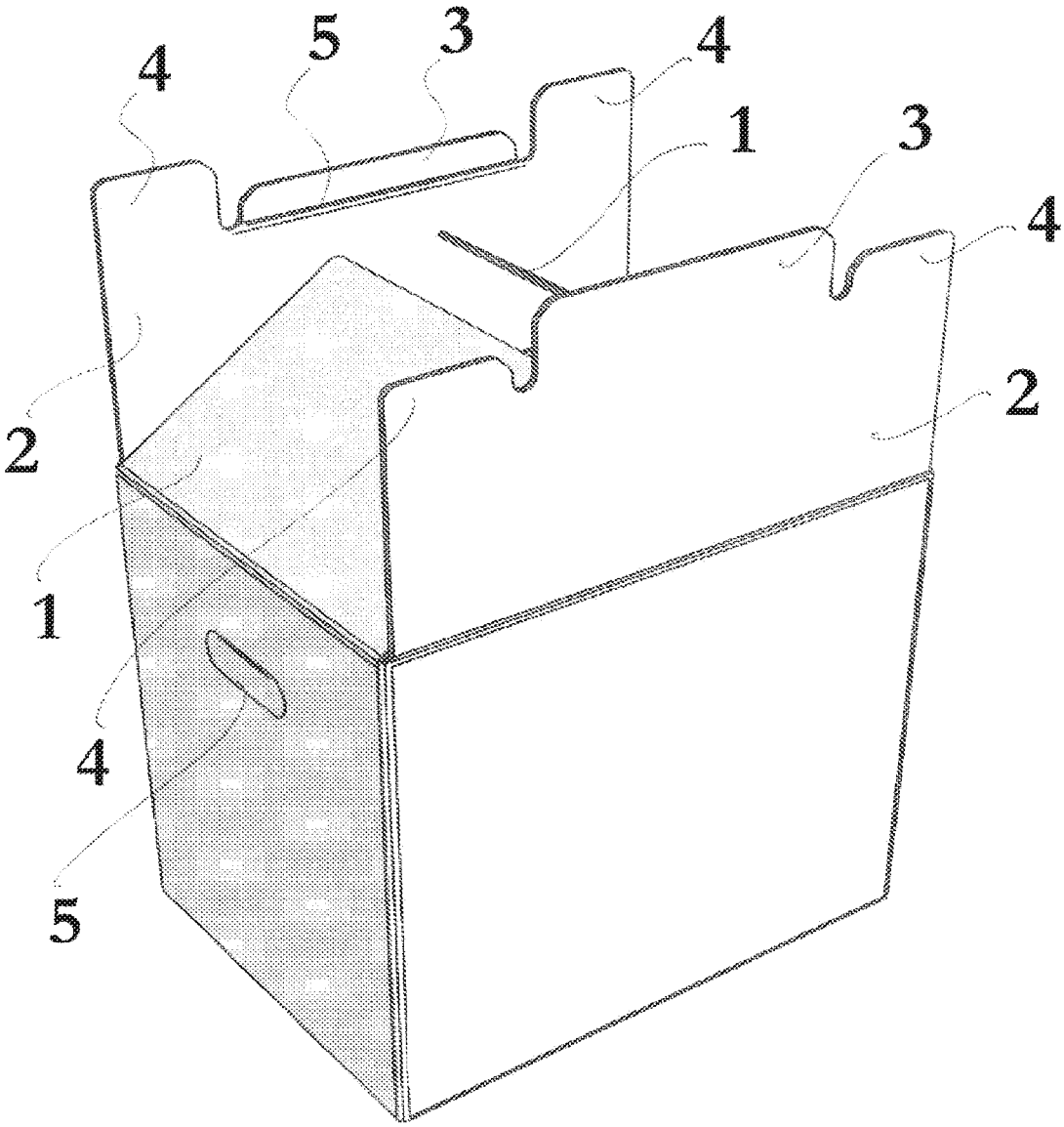
FIGS. 2-4 are perspective views of the box of the present invention during its closing operation to be used as a storage box for preparing orders ("picking"), according to said first embodiment.

In FIGS. 2-4 the closing process of the box of the present invention when used as a storage box is shown. The opening process is opposite to the closing process.

As shown in FIG. 2, the first closing flaps 1 are folded inwardly first, which will serve as a reinforcement of the lid.

Subsequently, said second closing flaps 2 are folded, so that tabs 3, 4 engage to each other in a complementary way (FIG. 3).

FIG. 4 shows the box of the present invention in its closing position for its use as a storage box or for preparing orders ("picking"). For this use no additional closing element is needed, independent from the box itself, as the box can be closed by the closing element of the second closing flaps 2.

Therefore, dust and dirt getting inside the box is prevented, allowing opening and closing it as many times as needed, and also saving time when opening and closing the box for preparing orders.

Figure 5:
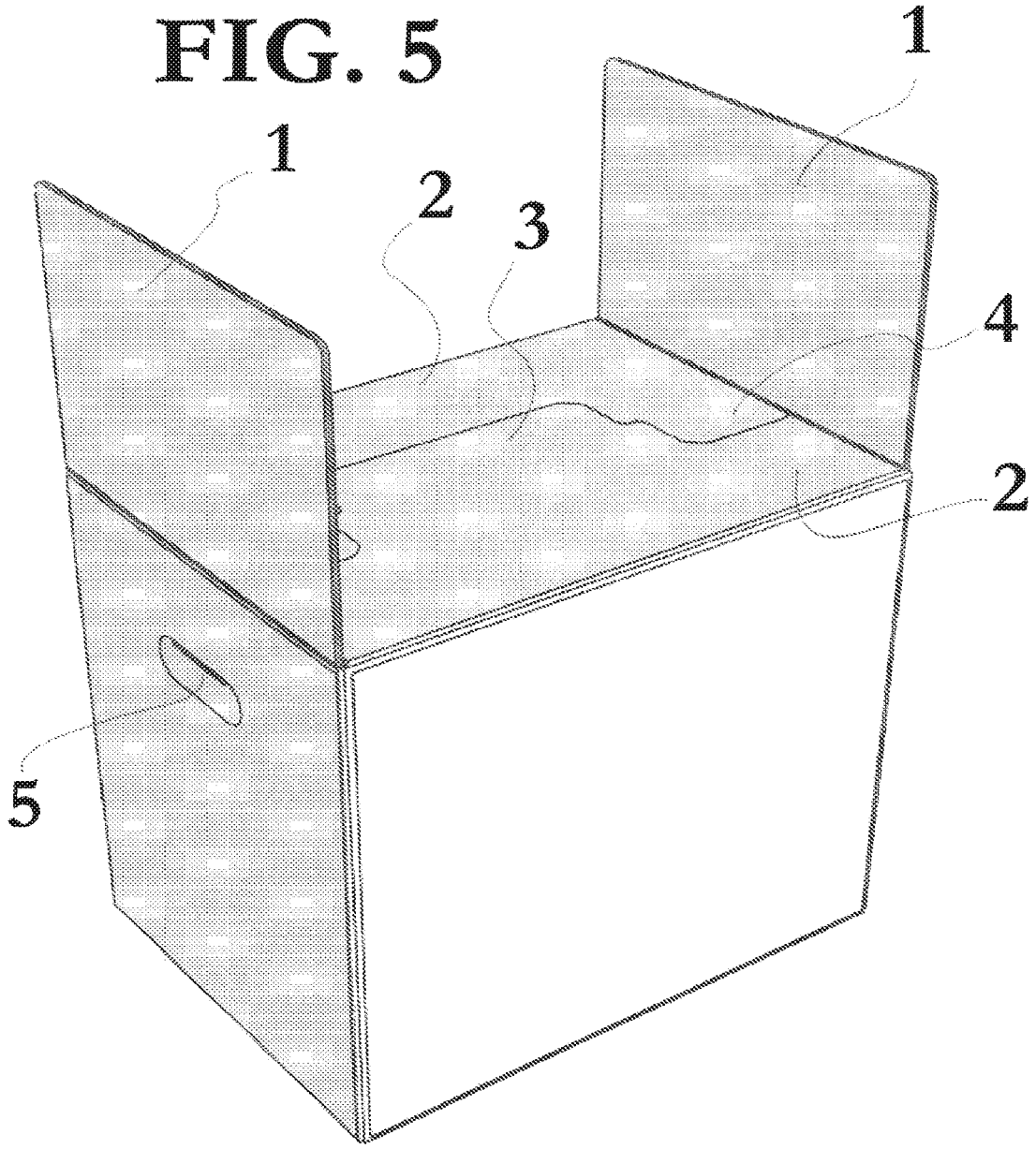
FIGS. 5-6 are perspective views of the box of the present invention during its closing operation to be used as a shipping box, according to said second embodiment.

On the other hand, when the box is used as a shipping or transportation box, the second closing flaps 2 must be folded to their substantially horizontal position first, as shown in FIG. 5.

Figure 6:
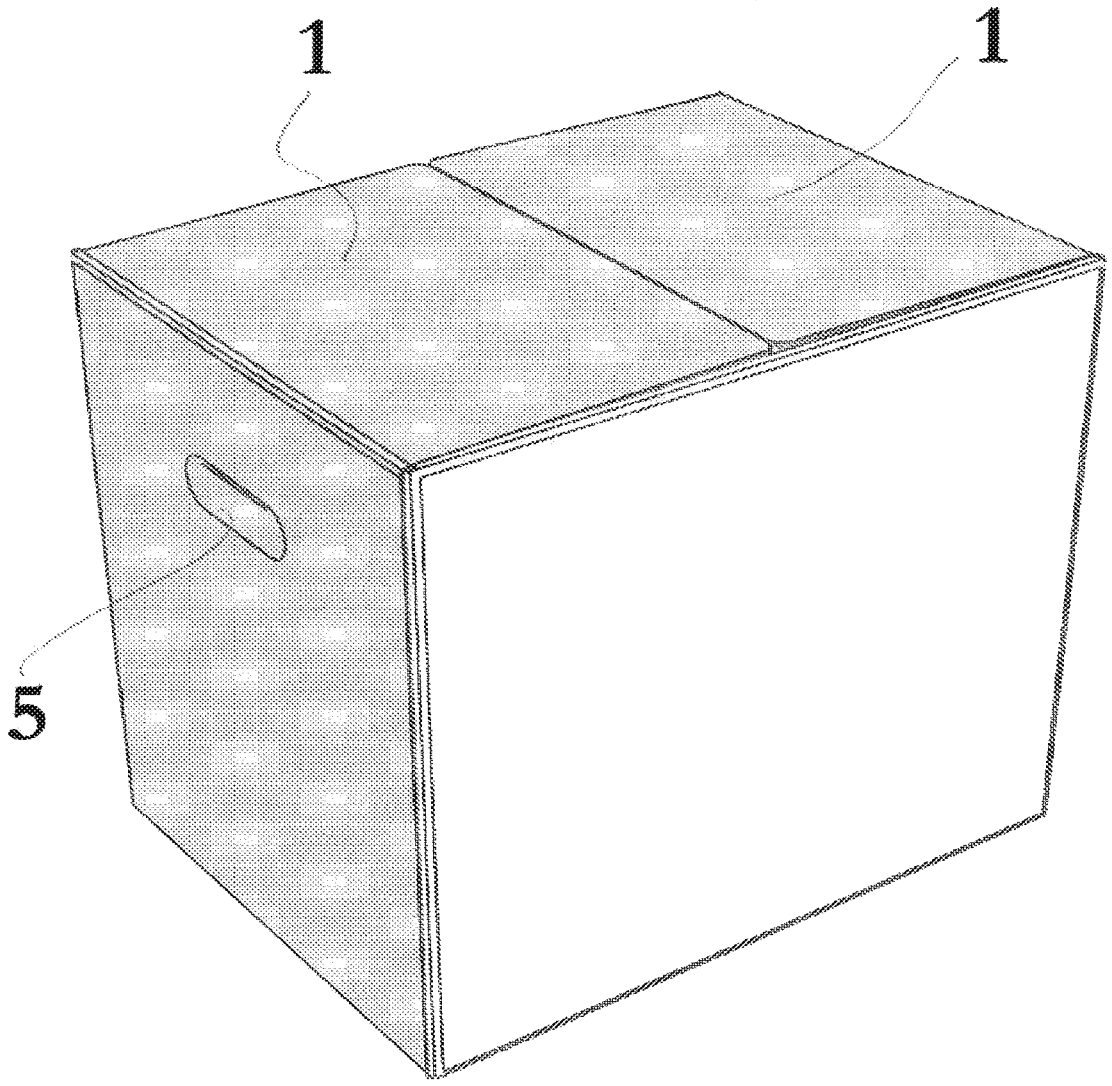

Then, the first closing flaps 1 of shipment are folded to their substantially horizontal position (FIG. 6).

FIG. 6 shows that the first closing flaps 1 of shipment must substantially cover the whole upper surface of the box in order to be able to carry out one or more shipments.

Preferably, said first closing flaps 1 of shipment are identical and are in contact with each other at their opposing ends. However, it must be pointed out that between the ends of said first closing flaps 1 there should be a gap big enough to place a sealing element such as adhesive tape, which in practice means this gap must not be greater than 6 cm.

Even though it is not shown in FIG. 6, on said opposing ends an adhesive tape, staples, glue or any other sealing element is applied to seal the box.

To open the box from its closing position when it is used for shipping or transporting, it is necessary to prior remove the adhesive tape or any other element used to seal the box. It is possible that when the adhesive tape, staples, glue or any other sealing element is removed, the first closing flaps 1 get damaged, which with the box of the present invention it is not a problem, since to close the box when it is used as storage box or for preparing orders ("picking"), the second closing flaps 2 are used.

If wished, said first flaps 1 of shipment can be of a size so that their ends are overlapped, such as in the embodiments shown in FIGS. 7-10.

Figure 7:
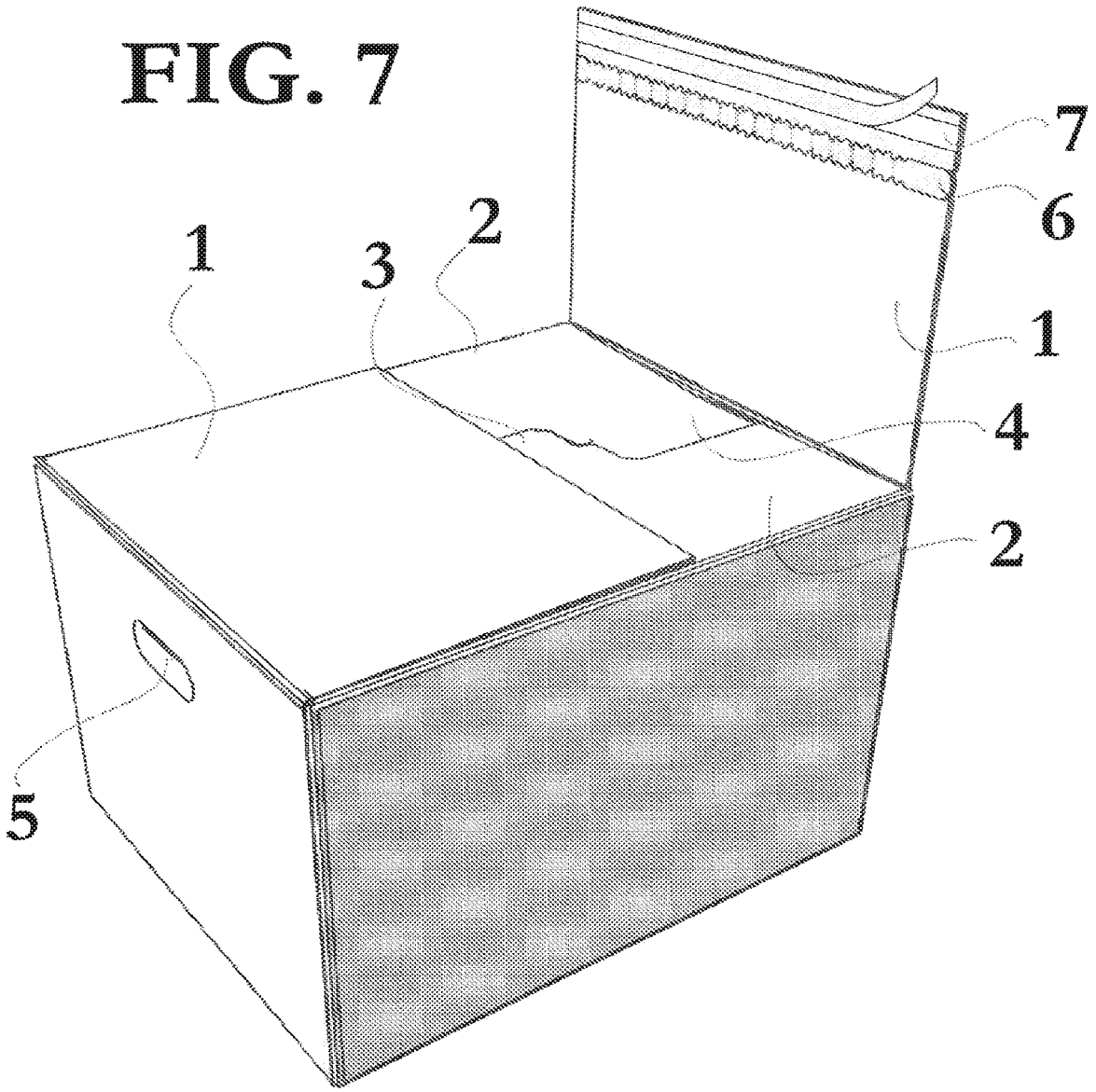
FIGS. 7 and 8 are perspective views of a second alternative embodiment of the box of the present invention, during its closing and opening, respectively.
Figure 8:
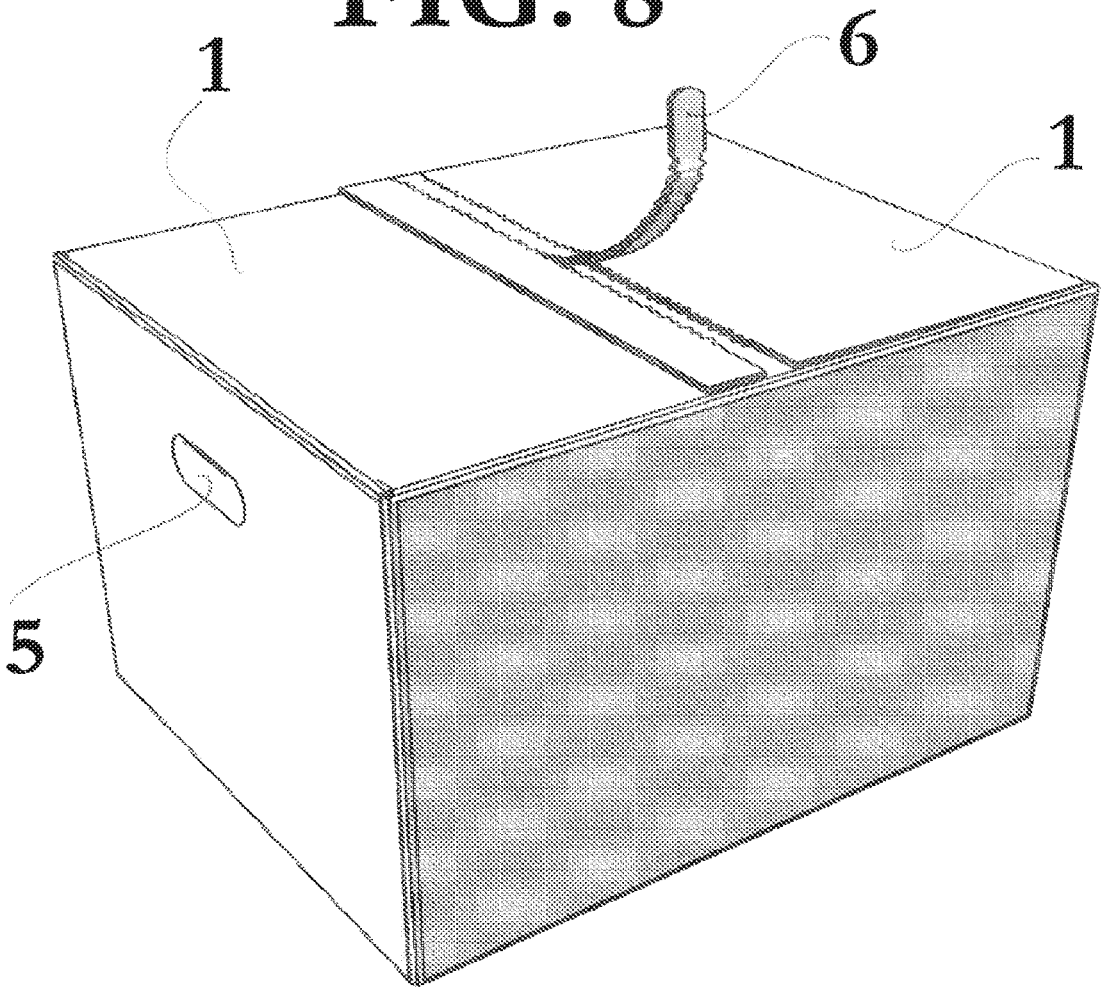

FIGS. 7 and 8 show a second embodiment of the box of the present invention. The main difference with regards to the embodiment of FIGS. 1-6 is the presence of a tear strip 6 to facilitate the opening of the box when it is used as a shipping or transportation box. The tear strip is defined by two pre-cut lines.

In this case, in its closed position, said tear strip 6 is overlapping the other of said first closing flaps 1.

Furthermore, in this second embodiment, one of said first closing flaps 1 comprises a double-sided adhesive tape 7 placed at the inner part of said closing flap 1. This double-sided adhesive tape 7 allows comfortably attaching said first closing flaps 1 to each other. To this end, said first closing flaps 1 must be partially or completely overlapped between each other.

To remove said tear strip 6, this comprises a grip zone at one of its ends, so that by pulling it the tear strip can be removed easily.

Figure 9:
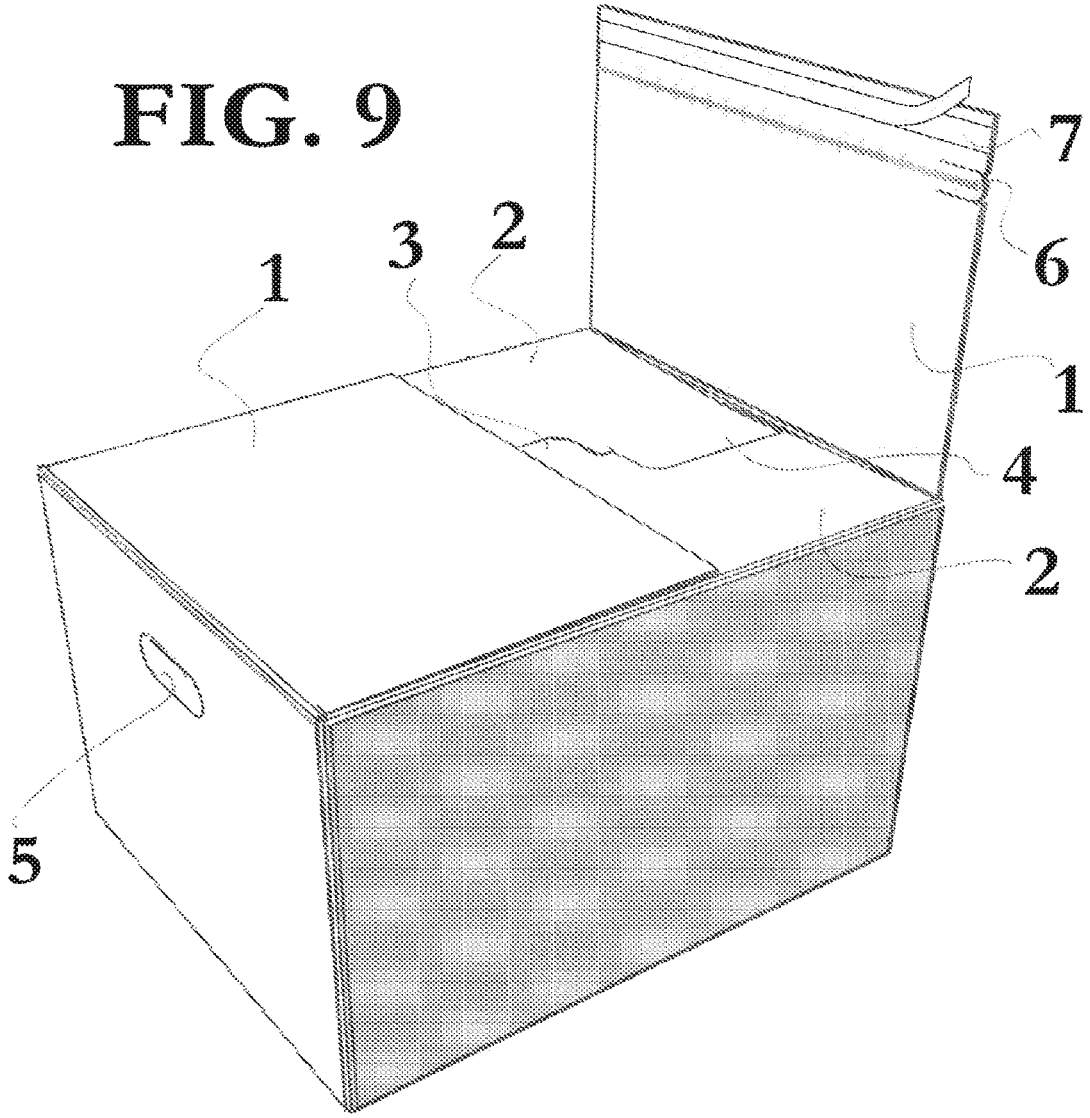
FIGS. 9 and 10 are perspective views of a third alternative embodiment of the box of the present invention, during its closing and opening, respectively.
Figure 10:
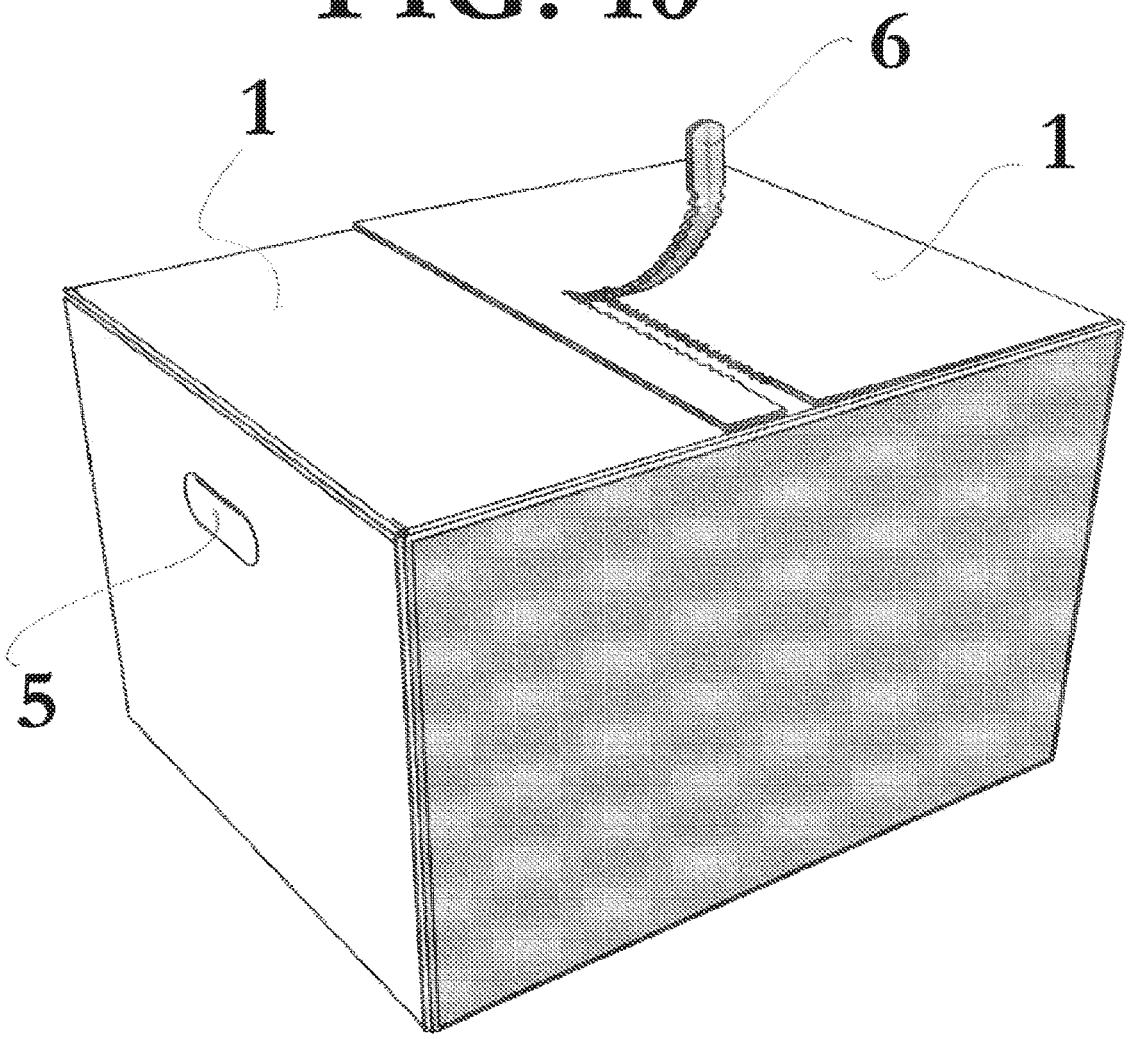

The third embodiment shown in FIGS. 9 and 10 is very similar to the second embodiment previously described. The only difference is the tear strip 6, which in this case is defined by a thread with enough strength to tear the cardboard of said first closing flap 1. Also in this case, one of the first closing flaps 1 comprises a double-sided adhesive tape 7.

It must be pointed out that the edges of the box of the present invention are obtained by cutting the sheet that determines the box by means of an anti-cut strip. This way the ends have a rough profile which prevents the user from cutting himself during its manipulation.

It must also be pointed out that the bottom of the box of the present invention can be any and, for this reason, it is not described in the present specification.

Figure 11:
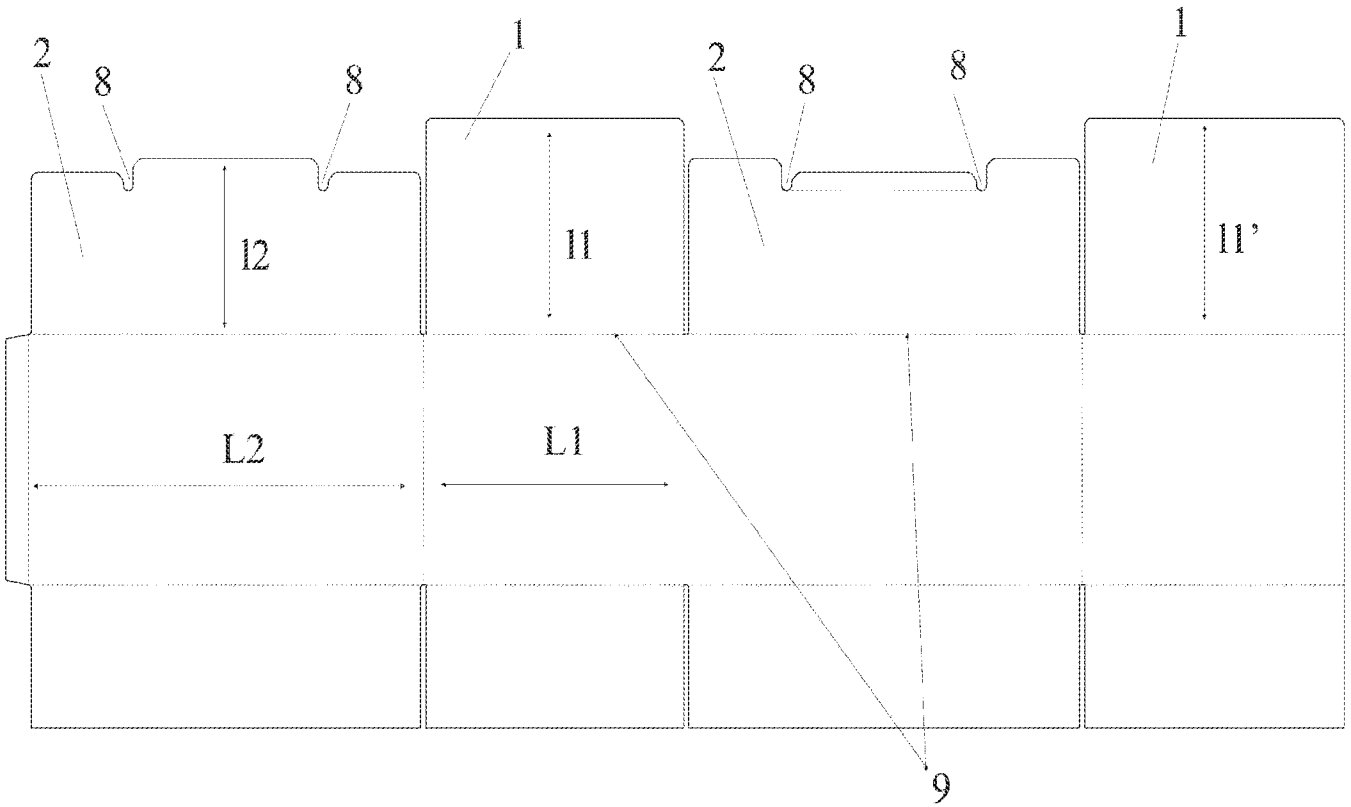
FIG. 11 is a plan view of a blank of the box of the present invention.

FIG. 11 shows a plan view of a box of the present invention whose parallelepiped body has been disassembled. Said FIG. 11 shows the alignment of the indents 9 of the sides of the upper face of the parallelepiped body which include the closing flaps 1, 2. As mentioned in the description of the invention, the alignment of the indents 9 facilitates the indiscriminate use of the two pairs of flaps for the closing of the exterior of the box.

In said FIG. 11, the distance 11,11' and 12 of the extension of the first 1 and second 2 closing flaps are represented, respectively, as well as the length L1 and L2 of the sides of the box from which said flaps 1, 2 extend.

As mentioned in the description of the invention and as seen in FIG. 11, in order to guarantee that the flaps 1 of shipment can be at least sealed by an adhesive tape, it will be essential to make sure that the sum of the length 11, 11' of said first flaps 1 is:

- equal to the length L2 of the sides of the box that include the second flaps 2 or,
- greater than the length L2 of the sides of the box that include the second flaps 2 or,
- equal to the length L2 of the sides of the box that include the second flaps 2
- minus a separation distance equal to or less than 7.5 cm, preferably equal to or less than 6 cm.

Even though reference has been made to a specific embodiment of the invention, it is evident for a person skilled in the art that the described storage and shipping box is susceptible of variations and modifications, and that all the details cited can be substituted by other technically equivalent ones, without departing from the scope of protection defined by the attached claims.

What is claimed is:

1. A storage and shipping box, comprising:

a first flap extending from a first side of an upper face of the box;

a second flap extending from a second side of the upper face of the box;

a third flap extending from a third side of the upper face of the box;

a fourth flap extending from a fourth side of the upper face of the box, the third flap and fourth flap being configured to be removably coupled to each other via a closing element configured to allow the third flap and the fourth flap to interlock; and a tear strip disposed on the first flap, the tear strip being configured to remove a portion of the first flap, wherein the first flap and the second flap are configured to be in a non-interlocking sealable position both prior to and subsequent to removing the portion of the first flap so that the first flap and the second flap are sealable with a sealing element prior to and subsequent to removing the portion and so that the box can carry out one or more shipments prior to and subsequent to being used for storage by closing the box with the third flap and the fourth flap.

2. The storage and shipping box according to claim 1, wherein the second side of the upper face of the box is opposite the first side of the upper face of the box.

3. The storage and shipping box according to claim 1, wherein:

a distal end of the first flap overlaps a distal end of the second flap a first distance when in the non-interlocking sealable position prior to removing the portion of the first flap; and the distal end of the first flap overlaps the distal end of the second flap a second distance when in the non-interlocking sealable position subsequent to removing the portion of the first flap.

4. The storage and shipping box according to claim 3, wherein the second distance is smaller than the first distance.

5. The storage and shipping box according to claim 1, wherein the tear strip overlaps the second flap when the first flap is in the non-interlocking sealable position prior to removing the portion of the first flap.

6. The storage and shipping box according to claim 5, wherein the portion of the first flap removed by the tear strip overlaps the second flap when the first flap is in the non-interlocking sealable position prior to removing the portion of the first flap.

7. The storage and shipping box according to claim 1, wherein at least one of the first flap and the second flap comprises a double-sided adhesive tape.

8. The storage and shipping box according to claim 1, wherein subsequent to removing the sealing element, either the first flap and the second flap or the third flap and the fourth flap can be closed first, such that the box can be used interchangeably for shipping and storage subsequent to removing the sealing element.

9. The storage and shipping box according to claim 1, wherein the third side of the upper face of the box is opposite the fourth side of the upper face of the box.

10. The storage and shipping box according to claim 1, wherein the closing element further comprises:

slots provided in opposing ends of the third flap and the fourth flap.

11. The storage and shipping box according to claim 10, wherein the closing element further comprises:

a series of tabs configured to be interlocked through the slots provided in the opposing ends of the third flap and the fourth flap.

12. The storage and shipping box according to claim 11, wherein at least one tab of the series of tabs comprises a folding line.

13. The storage and shipping box according to claim 1, wherein the third flap extends from the upper face of said box at a distance that is greater than half a length of either the first side or the second side.

14. A method of using the box of claim 1, comprising the steps of:

at a first time, using the box as a shipping box by sealing the first flap to the second flap with a double-sided adhesive to close an exterior of the box;

at a second time, removing the tear strip to unseal the first flap from the second flap and allow access to an interior of the box;

at a third time, using the box as storage box by closing the exterior of the box with the third flap and the fourth flap; and at a fourth time, using the box as a shipping box by sealing the first flap to the second flap with the sealing element to close the exterior of the box.

15. The storage and shipping box according to claim 1, wherein two or more adjacent flaps of the first flap, the second flap, the third flap, and the fourth flap are connected through one or more points.

16. The storage and shipping box according to claim 1, wherein a distal end of the first flap is separated from a distal end of the second flap by a distance equal to or less than 7.5 cm when the first flap and the second flap are in the non-interlocking sealable position.

17. A storage and shipping box, comprising:

a first flap extending from a first side of an upper face of the box;

a second flap extending from a second side of the upper face of the box;

a third flap extending from a third side of the upper face of the box;

a fourth flap extending from a fourth side of the upper face of the box, the third flap and fourth flap being configured to be removably coupled to each other via a closing element configured to allow the third flap and the fourth flap to interlock; and a tear strip disposed on the first flap, the tear strip being configured to remove a portion of the first flap, wherein the first flap and the second flap are configured to be in an overlapped position both prior to and subsequent to removing the portion of the first flap so that the first flap and the second flap are sealable with a sealing element prior to and subsequent to removing the portion and so that the box can carry out one or more shipments prior to and subsequent to being used for storage by closing the box with the third flap and the fourth flap.

18. The storage and shipping box according to claim 17, wherein:

a distal end of the first flap overlaps a distal end of the second flap a first distance when in the non-interlocking sealable position prior to removing the portion of the first flap; and the distal end of the first flap overlaps the distal end of the second flap a second distance when in the non-interlocking sealable position subsequent to removing the portion of the first flap, the second distance being smaller than the first distance.

19. The storage and shipping box according to claim 17, wherein opposing ends of the first flap and the second flap are configured to overlap in a non-interlocking manner subsequent to the removal of the portion.

20. The storage and shipping box according to claim 17, wherein the second flap does not include a tear strip.

* * * * *